US005829411A

United States Patent [19]

Cooper et al.

[11] Patent Number: 5,829,411

[45] Date of Patent: Nov. 3, 1998

[54] WEAR-RESISTANT FUEL DISTRIBUTOR ROTOR

[75] Inventors: Anthony A. Cooper; John D. Lane; Steven E. Ferdon; Scott R. Simmons, all of Columbus, Ind.

[73] Assignee: Cummins Engine Company, Inc., Columbus, Ind.

[21] Appl. No.: 938,354

[22] Filed: Sep. 29, 1997

Related U.S. Application Data

[63] Continuation of Ser. No. 734,137, Oct. 21, 1996, Pat. No. 5,713,333.

[51] Int. Cl.[6] ..... F02M 41/00

[52] U.S. Cl. ..... 123/450

[58] Field of Search ..... 123/450, 448–9; 137/625.11, 625.47; 251/315.04, 304

[56] References Cited

U.S. PATENT DOCUMENTS

| | | | |
|---|---|---|---|
| 3,934,612 | 1/1976 | Kast | 251/368 |
| 4,548,125 | 10/1985 | Hüther . | |
| 4,555,223 | 11/1985 | Budecker et al. | 417/462 |
| 4,614,453 | 9/1986 | Tsuno et al. . | |
| 4,751,871 | 6/1988 | Burghardt et al. . | |
| 4,777,844 | 10/1988 | DeBell et al. . | |
| 4,932,432 | 6/1990 | Berchem | 251/368 |
| 4,955,284 | 9/1990 | Faulkner . | |
| 5,409,165 | 4/1995 | Carroll, III et al. . | |
| 5,613,839 | 3/1997 | Buckley | 417/462 |
| 5,713,333 | 2/1998 | Cooper et al. | 123/450 |

*Primary Examiner*—Thomas N. Moulis
*Attorney, Agent, or Firm*—Sixbey, Friedman, Leedom & Ferguson; Charles M. Leedom, Jr.; Tim L. Brackett, Jr.

[57] ABSTRACT

A wear resistant, reduced stress at increased injection pressure fuel distributor assembly for distributing high pressure fuel to the fuel injectors of an internal combustion engine is provided. The assembly includes a fuel distributor rotor with a surface profile configuration that effectively and efficiently distributes high and low pressure fuel to the fuel injectors without internal fuel distribution channels. The rotor is preferably formed from a high thermal expansion, wear-resistant ceramic or coated metal material.

18 Claims, 2 Drawing Sheets

WEAR-RESISTANT FUEL DISTRIBUTOR ROTOR

This is a Continuation application of Ser. No. 08/734.137, filed Oct. 21, 1996, now U.S. Pat. No. 5,713, 333.

TECHNICAL FIELD

This invention relates generally to fuel distribution assemblies for internal combustion engines and is particularly concerned with a scuff and wear-resistant rotor for an internal combustion engine fuel distribution assembly designed to run at lower stress in internal rotor drillings while achieving higher injection pressure using a unique surface profile configuration that more effectively conducts fuel through the distributor.

BACKGROUND OF THE INVENTION

In some internal combustion engine fuel injector applications, particularly diesel fuel injection applications, the components of the fuel distribution assembly reach very high temperatures. The energy generated through the dissipation of fuel pressure in the distributor rotor increases the temperature of the distributor rotor at a faster rate than the temperature of the distributor housing. This temperature increase causes the rotor to expand in diameter so that it approaches the housing wall as it rotates. In many engine settings, the distributor assembly is extremely sensitive to even very small differences in diametral expansion because room temperature clearances between the distributor rotor and distributor housing are on the order of 2 to 3 microns. When a distributor rotor operates with such a close operating clearance, the metal-to-metal contact between the expanded rotor and the housing causes scuffing. Low lubricity fuel, alternative fuels and water contamination increase the likelihood of scuffing in diesel fuel injector systems. Progression of the wear due to scuffing may result in seizure of the distributor rotor and, ultimately, the failure of the fuel injection system.

Ceramic materials, such as, for example, zirconia, alumina, silicon carbide and the like, have been proposed to replace steel and other metals in internal combustion engine components. Such ceramics have been suggested for use in forming some components of gas turbine and diesel engines. However, it is difficult to form mechanical engine components from ceramic materials alone due to their poor toughness and tendency to exhibit low tensile strength. Therefore, ceramic materials are often used in internal combustion engine components in the form of composite structural bodies in which a metallic and a ceramic are bonded or otherwise secured together. However, ceramic-metal interfaces tend to show low adhesive wear due to material incompatibility and the high hardness of wear-resistant ceramic and metal used for this purpose.

U.S. Pat. No. 4,614,453 to Tsuno et al. discloses a metal-ceramic composite body useful for various internal combustion engine components, including a tappet and a turbocharger rotor. The configuration of the metal-ceramic composite disclosed therein is selected to reduce the stress concentration due to the bending load. The problems encountered with a shaft rotating at high speeds and minimal clearance within a bore to distribute pressurized fuel are not even remotely addressed by Tsuno et al. U.S. Pat. No. 4,955,284 to Faulkner, which discloses a piston with ceramic parts, is also directed to minimizing stresses at ceramic-metal interfaces.

It has been suggested to form some engine components from ceramics, in part to compensate for the thermal expansion. U.S. Pat. No. 5,409,165 to Carroll et al., for example, discloses a plunger assembly for a fuel injector formed from a ceramic material. However, this plunger assembly does not include a rotating component which must maintain a very small diametral clearance during engine operation and is not required to provide fuel distribution paths and outlets for high and low pressure fuel.

The prior art, however, has not suggested forming a distributor rotor either from a ceramic-metal composite or entirely from a ceramic material. A conventional metal distributor rotor may function effectively at lower fuel injection pressures, for example on the order of 13,000 psi. However, at higher injection pressures, such as those on the order of 18,000 to 20,000 psi or greater, expansion of the metal rotor causes the rotor to rotate so close to the distributor rotor housing that the rotor contacts the housing. The friction generated from the resulting metal-to-metal contact causes excessive wear on the rotor shaft, ultimately resulting in scuffing, shaft seizure and assembly failure. Seizure of a conventional metal rotor is likely to occur if the distributor rotor becomes friction welded to the housing.

Friction welding from thermal expansion is not, however, the only difficulty faced by distributor rotors in high pressure fuel distribution systems. Stress fractures due to tensile stress may also occur in distributor assemblies. Traditionally, fuel is transported to passages in the distributor housing by throughport channels within the rotor positioned axially and substantially perpendicular to the rotor axis. While such systems have proven their practicality in the field, this design may result in high internal cyclic stress resulting from fuel pressure and could cause stress fractures in the rotor material in a high pressure fuel system. The prior art does not appear to have addressed this problem.

The prior art, therefore, has failed to provide a distributor assembly and, in particular, a reduced stress at high injection pressure distributor rotor which functions effectively at high engine fuel pressures without rotor wear and operation problems. Consequently, there is a need for an internal combustion engine fuel distributor assembly including components capable of adapting to differential thermal expansion and resisting material fatigue, wear and tensile stress under high fuel pressures so that engine reliability is improved over a wide range of operating conditions.

SUMMARY OF THE INVENTION

It is a primary object of the present invention, therefore, to overcome the disadvantages of the prior art and to provide a distributor assembly for an internal combustion engine fuel system operating at high fuel pressures which improves engine performance.

It is another object of the present invention to provide a distributor assembly for an internal combustion engine high pressure fuel system which includes ceramic and metal components capable of operating for long periods of time without scuffing or seizing.

It is a further object of the present invention to provide a distributor assembly for an internal combustion engine high pressure fuel system which cost effectively eliminates excessive wear of the distributor assembly components.

It is yet another object of the present invention to provide a distributor assembly for an internal combustion engine high pressure fuel system which includes a rotor component with reduced stress and improved wear resistance over prior art distributor rotors.

It is still another object of the present invention to provide a fuel distribution rotor for a distributor assembly for an internal combustion engine high pressure fuel system externally configured to effectively distribute high pressure fuel to a plurality of different fuel passages in the assembly.

It is a still further object of the present invention to provide a ceramic fuel distributor rotor which employs a unique surface profile to distribute fuel to the fuel injectors in an internal combustion engine.

The foregoing objects are achieved by providing a distributor assembly for an internal combustion engine high pressure fuel system including a distributor housing with a fuel distributor rotor rotatably mounted in a corresponding bore in a sleeve in the housing. The distributor rotor is formed of a selected wear-resistant material and is externally configured to have a profile which efficiently transmits high pressure fuel to a plurality of separate engine fuel injectors and low pressure fuel as required to equalize pressure prior to a fuel injection event.

Other objects and advantages will become apparent following an examination of the following description, drawings and claims.

DETAILED DESCRIPTION OF THE INVENTION

Figure 1:
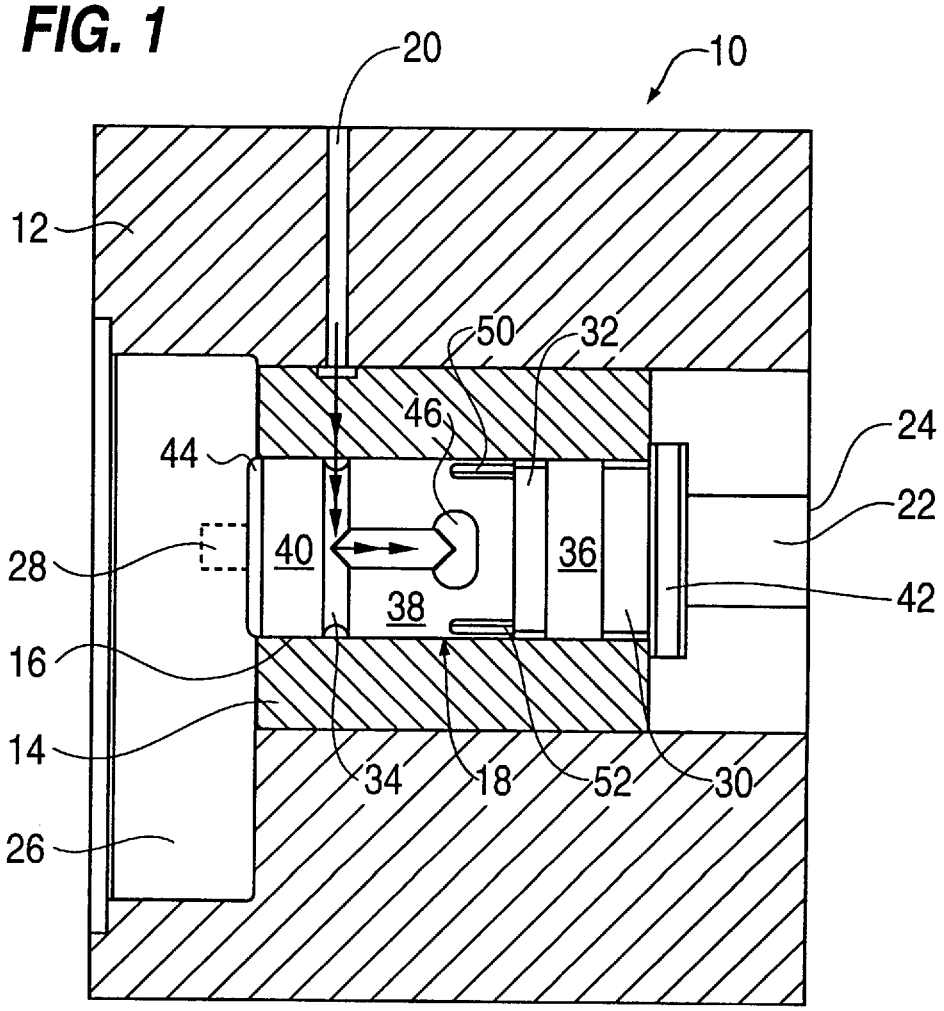
FIG. 1 is a side cross-sectional view of a distributor assembly according to the present invention.

During the normal operation of an internal combustion engine fuel distribution system, the distributor rotor in the fuel distribution system is required to rotate within the distributor housing thousands of times each minute to supply fuel to the engine fuel injectors. Moreover, heat is generated by the expansion of high pressure fuel both at the end of fuel injection and from leakage through the clearance between the rotor and its housing. The generation of heat increases the temperature of the fuel distribution system components, causing these components to expand. Many fuel distribution systems are designed with an extremely close diametral operating clearance between the distributor rotor and the bore within which the rotor is mounted in the distributor housing. Consequently, the combination of the rotation of distributor rotor and the expansion of the rotor within the bore as it rotates can lead to contact between the rotor and bore during engine operation. This causes scuffing of the rotor and could result in seizure of the rotor so that it no longer rotates. In such systems the thermal expansion of the rotor and/or housing must be anticipated and compensatory measures taken to avoid problems. If the distributor rotor material expands at a faster rate than the distributor housing material, scuffing and, eventually, seizure can occur. The distributor assembly of the present invention has been designed to avoid such problems.

All of the internal combustion engine high pressure fuel systems of which the inventors are aware utilize a conventional fuel distribution assembly for directing fuel to each of the fuel injectors associated with a corresponding combustion cylinder in the engine. Such fuel distribution assemblies typically include a fuel distribution rotor that is rotatably mounted in a rotor bore in a distributor assembly housing. The fuel distribution rotor typically includes axially spaced fuel inlet and outlet ports which extend through the body of the rotor. These ports communicate with one another through a longitudinal axial bore in the cylindrically configured rotor. When the rotor is inserted into the distributor housing, a fuel inlet port communicates with a corresponding structure in the housing that, in turn, is connected to the output of a fuel pump which pumps fuel to the distributor assembly. A fuel outlet port in the rotor is registrable with a plurality of fuel distribution passages in the housing whose inlets are angularly spaced around the circumference of the rotor bore in the distributor assembly housing. These passages diverge from the bore in the housing like spokes and ultimately communicate with the fuel injectors that feed vaporized fuel into the combustion cylinders. The fuel distribution rotor is operatively linked to the engine camshaft so that it continuously rotates with the camshaft. Fuel is distributed by the distributor assembly to one or more fuel injectors as the fuel outlet port of the rotating rotor registers with a corresponding injector fuel distribution passage in the distributor assembly housing rotor bore.

While such fuel distribution assemblies work well in diesel engines employing fuel distribution systems that operate at conventional pressures, the inventors have observed that the fuel distribution rotor in such assemblies may exhibit excessive wear when this design is used to distribute fuel in high pressure fuel systems, and may even seize and, ultimately, fail over time. The inventors have further discovered that such excessive wear is caused by the high side loading on the fuel distribution rotor which occurs when fuel is pumped into the distributor assembly at high pressures. The pressure exerted by a high pressure fuel pulse in a high pressure fuel system causes the surface of the fuel distribution rotor opposite that where the fuel outlet port is located to contact the rotor bore in the distributor assembly housing, thereby breaking through the film of lubricant normally present between the rotor surface and the bore. This leads to scuffing of the rotor and, eventually, seizure of the rotor in the bore so that the distributor assembly becomes inoperative. The fuel distribution assembly of the present invention operates without such drawbacks in a high pressure fuel system environment.

With reference now to FIG. 1, which is not drawn to scale, the high pressure fuel distribution assembly 10 of the present invention includes a distributor housing 12 with a substantially cylindrical sleeve 14 positioned in the housing 12. The sleeve 14 includes a substantially cylindrical bore 16 to receive a substantially cylindrical fuel distribution rotor or shaft 18. The distributor housing 12 further includes a fuel inlet passage 20 and a plurality of fuel distribution passages 19 (not shown) to direct fuel to the engine fuel injectors (not shown) and cylinders (not shown) as will be described in detail below. The fuel distribution rotor 18 is mounted for rotation within the bore 16. Because the optimum operational room temperature diametral clearance between the distributor rotor 18 and the bore 16 is on the order of 2 to 8 microns and preferably 2 to 3 microns, even small differences in diametral expansion of the rotor can affect its ability to rotate within the bore.

On one end of the distribution rotor 18 is formed an axial extension 22 which extends to an end cap section 24 in the distributor housing. The opposite end of the distributor rotor 18 includes a shaft projection 28 which is connected to a drive mechanism (not shown) associated with a gear pump 26. The rotor 18 is operatively connected through the drive mechanism to the engine camshaft (not shown) so that the rotor is driven to rotate as the camshaft rotates.

The surface configuration and profile of the distributor rotor 18 of the present invention have been selected to reduce tensile stress and to avoid other problems characteristic of currently available distributor rotor designs. Unlike these distributor rotors, the rotor design of the present invention does not use fuel throughport passages which extend through the body of the rotor but, instead, the present fuel distribution assembly employs the surface profile of the rotor to receive incoming fuel and distribute this fuel through the fuel distribution passages to the engine fuel injectors. FIGS. 2–5 illustrate the features of the rotor surface configuration and profile which enable the rotor to perform its fuel distribution function without internal fuel passages.

Figure 3:
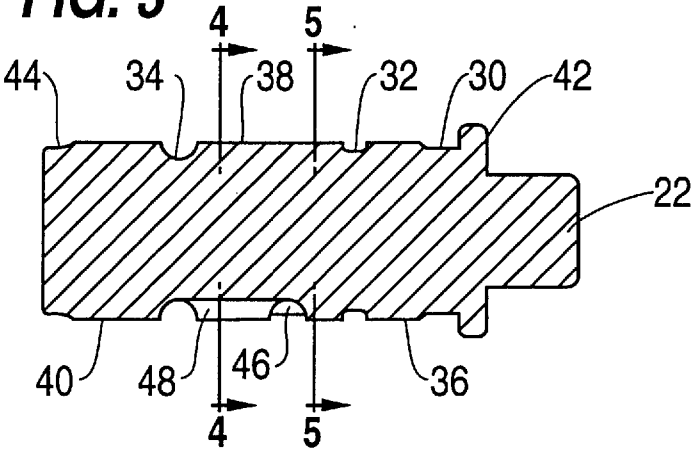
FIG. 3 is a longitudinal cross-sectional view of the distributor rotor of FIG. 2 turned 90° in a clockwise direction.
Figure 5:
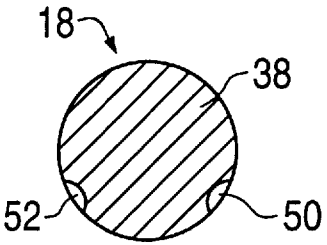
FIG. 5 is a cross-sectional view of the distributor rotor of FIG. 3 taken along line 5—5.
Figure 2:
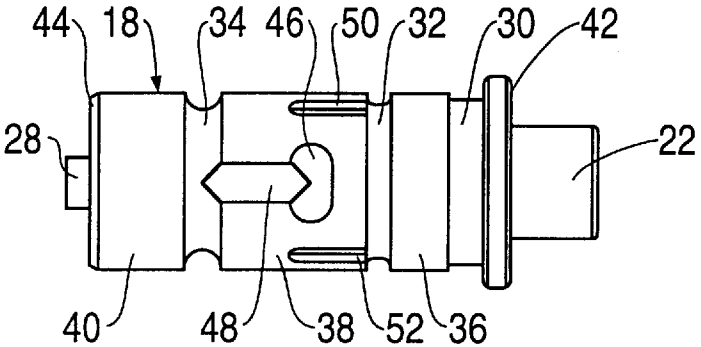
FIG. 2 is a side view of a distributor rotor according to the present invention.
Figure 4:
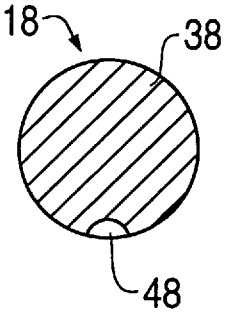
FIG. 4 is a cross-sectional view of the distributor rotor of FIG. 3 taken along line 4—4.

The external surface profile of the distributor rotor of the present invention is illustrated in FIG. 2, and the cross-sectional rotor profile is illustrated in FIG. 3. In FIG. 3 the rotor has been rotated 90° clock-wise from the rotor position shown in FIG. 2. FIGS. 4 and 5 illustrate features of the rotor surface profile in cross-sections taken along respective lines 4—4 and 5—5 at the rotor locations shown in FIG. 3. FIG. 3 clearly illustrates that there are no internal fuel distribution passages within the distributor rotor 16. Consequently, the rotor design of the present invention is subjected to lower stress during the injection of high pressure fuel than rotor designs with throughport fuel channels, and rotor failure due to tensile stress is substantially eliminated. Fuel is transmitted by the surface profile of the present distributor rotor from a high pressure fuel supply to a fuel outlet port and from there to the injectors. Low pressure fuel ports transfer lower pressure fuel from the gear pump, as will be explained below. These "ports" are not openings to passages, but are recesses formed integrally in the rotor surface as will be shown below.

FIG. 2 shows the surface profile of the distributor rotor 18 viewed from the same direction as that shown in the distributor rotor assembly of FIG. 1. The longitudinal profile of the distribution rotor shaft 18 between the shaft extension 22 and the shaft projection 28 includes reduced diameter groove sections or annuli 30, 32 and 34, alternating with full diameter land sections 36, 38 and 40. An extended diameter section 42 is located outside the sleeve in the housing 12 between the reduced diameter section 30 and the shaft extension 22. Full diameter section 40, which is adjacent to the shaft projection 28, includes a chamfered edge 44. The extended diameter land section 42, in conjunction with the axial extension 22, controls the axial movement of the rotor shaft 18 during engine operation so that the axial movement is limited to about 0.25 mm. The size of the extended diameter land section 42 also facilitates the rotor manufacturing process by enabling the rotor to be driven on a larger diameter shaft during the grinding process.

The full diameter land section 38 includes a fuel outlet port 46 integrally formed in the body of the rotor 18 to include an axial extension channel 48 which terminates at the annulus 34. The fuel inlet passage 20 is aligned with annulus 34. The annulus 34 is formed with a concave curve as shown to enhance fuel distribution efficiency. Full diameter section land 38 further includes a pair of low pressure fuel outlets 50 and 52 which extend from annulus 32 toward annulus 34.

FIG. 3 is a longitudinal cross-section of another view of the profile of the rotor 18 of FIG. 2 showing the rotor turned 90° clockwise from the position of the rotor 18 in FIGS. 1 and 2. The fuel outlet port 46 and axial extension channel 48 are therefore shown at the bottom of the rotor in FIG. 3.

FIGS. 4 and 5 illustrate cross-sectional views of the configuration of full diameter land section 38 of the distributor rotor 18 taken along lines 4—4 and 5—5, respectively, of FIG. 3. FIG. 4 shows the relative depth of the axial extension channel 48 in the body of the rotor 18. FIG. 5 illustrates the relative positions and depth of the low pressure fuel outlets 50 and 52 in the body of the rotor 18. The low pressure fuel outlets 50 and 52 are positioned about 120° apart along the circumference of rotor fuel diameter section 38. This allows the rotor 18 to transfer low pressure fuel simultaneously to two injectors before rotating to a different position.

The surface configuration of the distribution rotor 18 has been designed to conduct both high and low pressure fuel as required during engine operation. High pressure fuel, that is, fuel with a pressure of about 20,000 psi, is directed into the distributor housing through the fuel inlet passage 20. The rotor 18 is positioned within the sleeve 14 so that the annulus 34 is aligned with the fuel passage 20. High pressure fuel is directed from the fuel passage 20 to the annulus 34, which functions as a high pressure fuel inlet, and from annulus 34 along extension channel 48 to the fuel outlet 46, as shown by the arrows in FIG. 1. The fuel outlet 46 is position to register, in turn, with one of each of the injection lines (not shown) during operation to transfer high pressure fuel to each of the engine fuel injectors (not shown). This distributor rotor shown in the drawings distributes fuel to six injection lines. Other numbers of injection lines can also be accommodated by present distributor assembly.

Concurrently, the annulus 32 functions as a fuel inlet and receives low pressure fuel from the engine gear pump 26 through a low pressure fuel channel (not shown) in the distributor housing. This low pressure fuel will typically have a pressure less than 200 psi. The low pressure fuel is received by the distribution assembly and transferred to the fuel injection lines to collapse cavitation that may result at the end of the fuel injection event from the depressurization that occurs at the end of the previous injection event. The low pressure fuel received by fuel inlet annulus 32 also equalizes the pressure in the injector fuel lines prior to the injection event. The low pressure fuel outlets 50 and 52 are aligned with the injector lines and direct low pressure fuel from the low pressure fuel inlet annulus 32 to the injector lines to collapse cavitation in the injector lines.

When fuel is pressurized to 20,000 psi and then depressurized at the end of the injection event, leakage of fuel occurs around the rotor 18 in the transition from high to low pressure regions. In operation, the generation of heat by the expansion of high pressure fuel at the end of injection from leakage through the clearance between the rotor 18 and sleeve 14 increases the temperature of the distributor assembly components and the temperature of the fuel transmitted through the assembly. With the increase in temperature, thermal expansion occurs in both the sleeve 14 and the distributor rotor 18. If the distributor rotor 18 expands at a faster rate than the sleeve 14, because the clearance between the rotor and sleeve is only on the order of 2 to 8 microns, the expansion will cause the distributor rotor 18 to contact the wall of the sleeve 14, which results in scuffing of the rotor. Excessive scuffing may lead to distribution rotor seizure. If the rotor becomes friction welded to the sleeve, the distributor fails to transfer fuel to the injectors and the engine cannot operate.

Conventional distributor rotors have been made entirely of metal, typically a gas nitrided alloy steel. While these rotors work well at lower injection pressures, such as those in the range of about 13,000 psi, they do not function effectively at the higher injection pressures required in some newer engine designs. At injection pressures of about 18,000 psi, for example, a metal rotor tends to rotate too close to the wall of the rotor sleeve, which causes excessive scoring and abrasive wear damage. The distribution rotor is also subject to local heating and side loading as it transfers hot fuel through the fuel outlet port. The unchecked progression of this kind of wear is likely to result in seizure of the rotor after only about 50 to about 100 hours of operation.

The distributor rotor of the present invention solves the foregoing problems and can operate at high injection pressures without the scuffing or wear which characterize metal rotors. This is accomplished by forming the distribution rotor 18 out of a high tensile strength, wear resistant material, preferably a ceramic material or a coated metal. A distributor rotor formed from one of these materials can run for at least 1000 hours without any wear damage and without scuffing or seizure and will not adhere or weld to a metal distributor bore. Similar results have been obtained with certain coated metals. The use of such a material to form the rotor 18 and a metal to form the distributor rotor sleeve 14 produces the benefit of thermal expansion mismatch. The thermal expansion coefficient of a wear-resistant, high thermal expansion ceramic, for example, is 20 percent less than the thermal expansion coefficient for the nitrided steel typically used to form distributor rotors and housings. This thermal expansion difference means that a ceramic rotor will not expand as quickly as the metal distributor housing. Therefore, the diametral clearance between the rotor and the bore does not decrease like the diametral clearance between a metal rotor and a metal housing does, which reduces the likelihood of scuffing and rotor seizure. This thermal expansion difference, however, is small enough that fuel leakage remains at acceptable levels.

The ceramic material preferred for forming the distributor rotor of the present invention is preferably a zirconia ceramic. Zirconia ceramics have a low coefficient of friction, preferably in the range of about 0.05 to 0.15, which is in the same range as a lubricated zirconia on steel, a high thermal expansion coefficient, preferably in the range of about $9\times10^{-6}$ to $11\times10^{-6}$ mm/°C., and a high hardness, preferably about 1200 to 1400 Hv on the Knoop scale. A high thermal expansion coefficient ceramic will expand less than steel for an equal increase in temperature. Zirconia, for example, has a thermal expansion coefficient which is 75% to 80% of most steels. An additional desirable characteristic of the ceramic material is high tensile strength. One measure of a desirable tensile strength is three-point bend strength above 80 ksi. The three-point bend strength, or flexural strength, is a preferred tensile strength test for a brittle material like a ceramic. In addition, the incompatibility of such ceramics with steel precludes a ceramic rotor from adhering or welding to the steel distributor housing.

Although zirconia ceramics are preferred, other ceramics with similarly low coefficients of friction and high thermal expansion coefficients and high hardness could also be used to form the distributor rotor of the present invention. High thermal expansion ceramics such as zirconia, alumina-zirconia, and alumina have been shown in rig tests to have much better scuffing resistance than the metals typically used for forming distributor rotors. Low thermal expansion ceramics such as silicon nitride have also been shown to have superior scuff resistance; however, fuel leakage may be greater than desired with this class of materials. A particularly preferred ceramic for the distributor rotor of the present invention is a partially stabilized zirconia. A preferred stabilizer for this purpose is magnesia (MgO). The preferred stabilized zirconia may also be referred to by the designation MgPSZ. Zirconias suitable for the present invention are commercially available from Coors Ceramic Company and Kyocera Fine Ceramics.

Performance similar to that produced by the aforesaid ceramics has also been obtained by making the rotor 18 from a steel, preferably a tool steel, such as M2 steel, and coating the steel with a coating layer about 1 to 1.5 microns thick of a hard, wear-resistant coating material. Preferred coatings for this purpose are titanium nitride and tungsten carbide/amorphous carbon. Additional coatings are being evaluated for their ability to function like the preferred ceramics.

The distributor rotor 18 of the present invention is resistant to the scuffing problems characteristic of currently available metal distributor rotors because of the material incompatibility between the ceramic or coated metal rotor and the metal rotor sleeve, the high hardness of the material forming the rotor, and the lower thermal expansion coefficient of the rotor relative to the sleeve, which helps the rotor maintain an optimum operating clearance of 2 to 8 microns within the bore 16. In addition, the rotor 18 has a low specific heat, which means that local heat fluxes do not result in an immediate temperature increase in the ceramic or coated metal forming the rotor. Since the present rotor does not expand before the steel of the sleeve surrounding the bore can heat up, the necessary operating clearance between the rotor and the sleeve is maintained, even in the presence of the local heating and side loading which occur during operation of the fuel distributor.

Break-in tests, during which distributor rotors made of different materials were run at alternately high and low pressures and speeds for variable time intervals, were conducted. For example, a rotor would be operated at a high pressure and speed for 30 minutes and then at a low pressure and speed for one minute. The ceramic and coated metal rotors of the present invention ran at higher pressures for longer periods of time than steel rotors. In addition, rotors with the surface port design of the present invention did not exhibit the rotor fracture observed in rotors with through-ports.

Various changes and modifications to the preferred embodiment herein chosen for the purpose of illustration may occur to those skilled in the art. To the extent that such variations and modifications do not depart from the spirit of the invention, they are intended to be included within the scope thereof which is assessed only by fair interpretation of the following claims.

INDUSTRIAL APPLICABILITY

The wear-resistant, reduced stress at increased tensile strength distributor rotor of the present invention will find its primary application in a distributor used to supply high pressure fuel to the injectors in an internal combustion engine where optimum high pressure fuel distribution is desired.

We claim:

1. A fuel distribution rotor for rotational mounting at an optimum diametral clearance in a housing in an internal combustion engine fuel distribution assembly that distributes high pressure fuel to a plurality of fuel injectors, wherein said fuel distribution rotor has an integrally formed external surface profile including a plurality of alternating expanded diameter land sections separated by smaller diameter annulus sections; wherein one of said expanded diameter land sections includes integrally formed in the surface thereof a high pressure fuel outlet, a pair of integrally formed low pressure fuel outlet recesses, and a longitudinal extension in fluid communication with a smaller diameter annulus section adjacent to said fuel outlet; and wherein said smaller diameter annulus section is aligned with a supply of high pressure fuel in said housing during engine operation and is configured to function as a high pressure fuel inlet.

2. The fuel distribution rotor described in claim 1, wherein said rotor is formed of a ceramic selected from the group consisting of zirconia, alumina-zirconia and alumina ceramics or a coated metal selected from the group consisting of steel coated with titanium nitride and steel coated with tungsten carbide/amorphous carbon.

3. The fuel distribution rotor described in claim 2, wherein said rotor is formed of a ceramic having a thermal expansion coefficient within the range of about $9\times10^{-6}$ to about $11\times10^{-8}$ m/m/°C. and a hardness within the range of about 1200 to about 1400 Hv.

4. The fuel distribution rotor described in claim 3, wherein said ceramic is a stabilized zirconia.

5. The fuel distribution rotor described in claim 2, wherein said rotor is formed from a coated metal.

6. The fuel distribution rotor described in claim 1, wherein said fuel distribution rotor is formed of a wear-resistant material having a thermal expansion coefficient different from the thermal expansion coefficient of said housing.

7. The fuel distribution rotor described in claim 1, wherein each of said low pressure fuel outlet recesses is formed integrally on the surface of said expanded diameter land section to be circumferentially spaced about 120 degrees apart.

8. The fuel distribution rotor described in claim 1, further including an annular low pressure fuel inlet integrally formed in a smaller diameter annulus section adjacent to and in fluid communication with said low pressure fluid outlet recesses.

9. The fuel distribution rotor described in claim 1, wherein said high pressure fuel inlet has a concave annular configuration.

10. A fuel distribution rotor for receiving and distributing high and low pressure fuel in an internal combustion engine fuel distribution assembly, said fuel distribution rotor comprising a solid, wear-resistant shaft with an integrally formed surface profile configured to simultaneously receive and distribute high pressure and low pressure fuel, wherein an annular high pressure fuel inlet receives high pressure fuel and a high pressure fuel outlet recess in axial fluid communication with said high pressure fuel inlet discharges high pressure fuel received from said high pressure fuel inlet; and an annular low pressure fuel inlet spaced axially along said shaft from said high pressure fuel outlet away from said high pressure fuel inlet receives low pressure fuel and a pair of circumferentially spaced low pressure fuel outlet recesses in axial fluid communication with said low pressure fuel inlet discharge low pressure fuel received from said low pressure fuel inlet.

11. The fuel distribution rotor described in claim 10, wherein said high pressure fuel outlet recess and said pair of low pressure fuel outlet recesses are formed in the surface of an expanded diameter land section of said shaft, said high pressure fuel inlet comprises a first smaller diameter annulus section of said shaft adjacent to a first end of said expanded diameter land section, and said low pressure fuel inlet comprises a second smaller diameter annulus section of said shaft adjacent to a second, opposite end of said expanded diameter land section.

12. The fuel distribution rotor described in claim 11, further including an axial channel in said expanded diameter land section extending axially from said first end to said high pressure fuel outlet to provide fluid communication between said high pressure fuel inlet and said high pressure fuel outlet.

13. The fuel distribution rotor described in claim 12, wherein each one of said pair of low pressure fuel outlet recesses is spaced about 120° apart along the circumference of said expanded diameter land section.

14. The fuel distribution rotor described in claim 11, wherein said high pressure fuel distribution inlet has a concave annular configuration.

15. The fuel distribution rotor described in claim 10, wherein said shaft is formed of a ceramic selected from the group consisting of zirconia, alumina-zirconia and alumina ceramics or a coated metal selected from the group consisting of steel coated with titanium nitride and steel coated with tungsten carbide/amorphous carbon.

16. The fuel distribution rotor described in claim 15, wherein said rotor is formed of a ceramic having a thermal expansion coefficient within the range of about $9\times10^{-6}$ to about $11\times10^{-8}$ m/m/°C. and a hardness within the range of about 1200 to about 1400 Hv.

17. The fuel distribution rotor described in claim 16, wherein said ceramic is a stabilized zirconia.

18. The fuel distribution rotor described in claim 15, wherein said rotor is formed from a coated metal.

* * * * *